US006256823B1

(12) United States Patent
Kronbetter et al.

(10) Patent No.: US 6,256,823 B1
(45) Date of Patent: Jul. 10, 2001

(54) BELLOWS FOR FRONT LOADING WASHING MACHINES

(75) Inventors: Clarence W. Kronbetter, St. Joseph, MI (US); John J. Sudar, Jr., Canton, OH (US)

(73) Assignee: The Chardon Rubber Company, Chardon, OH (US)

( * ) Notice: Subject to any disclaimer, the term of this patent is extended or adjusted under 35 U.S.C. 154(b) by 0 days.

(21) Appl. No.: 09/342,879

(22) Filed: Jun. 29, 1999

(51) Int. Cl.[7] ..... D06F 37/28

(52) U.S. Cl. ..... 8/158; 68/24; 68/58; 68/139

(58) Field of Search ..... 68/3 R, 24, 58, 68/140, 139; 34/318, 603; 8/159; 134/200

(56) References Cited

U.S. PATENT DOCUMENTS

| | | | | |
|---|---|---|---|---|
| 2,296,257 | | 9/1942 | Brechenridge | 68/24 |
| 2,314,666 | * | 3/1943 | Stoddard | 134/200 |
| 2,352,363 | | 6/1944 | Bassett, Jr. | 68/24 |
| 2,613,837 | | 10/1952 | Morton | 220/15 |
| 2,625,031 | | 1/1953 | Kreitchman | 68/139 |
| 2,656,451 | | 10/1953 | Rick | 240/2 |
| 2,722,119 | | 11/1955 | Constantine | 68/139 |
| 2,960,780 | | 11/1960 | Stilwell, Jr. | 38/2 |
| 2,990,706 | * | 7/1961 | Bochan | 68/24 |
| 3,003,090 | * | 10/1961 | Neyhouse et al. | 68/24 |
| 3,089,327 | * | 5/1963 | Stilwell, Jr. | 68/24 |
| 3,276,229 | * | 10/1966 | Deiss | 68/24 |
| 3,477,259 | | 11/1969 | Barnish et al. | 68/23.1 |
| 5,548,978 | | 8/1996 | Bongini et al. | 68/17 |
| 5,570,597 | | 11/1996 | Bongini et al. | 68/17 |
| 5,860,300 | * | 1/1999 | Valent . | |
| 5,979,195 | * | 11/1999 | Bestell et al. . | |

FOREIGN PATENT DOCUMENTS

| | | | |
|---|---|---|---|
| 1189515 | * | 3/1965 | (DE) . |
| 2 403 705 | | 8/1974 | (DE) . |
| 1953201 | * | 10/1978 | (DE) . |
| 32 20 577 | | 12/1983 | (DE) . |
| 0 266 239 | | 5/1988 | (EP) . |
| 0 657 574 | | 6/1995 | (EP) . |
| 1426076 | | 2/1976 | (GB) . |
| 2216906 | | 10/1989 | (GB) . |
| 6409258 | | 8/1964 | (NL) . |

* cited by examiner

*Primary Examiner*—Frankie L. Stinson
(74) *Attorney, Agent, or Firm*—Renner, Kenner, Greive, Bobak, Taylor & Weber

(57) ABSTRACT

A bellows (44) for a front loading washing machine (10) having a front panel (13) providing a first channel (46) having opposed sidewalls (50), an opening (19) and a door (20) carried thereby, and further carrying a stationary drum (25), providing a second channel (48), having opposed sidewalls (52) and a rotatable drum (30), the bellows comprising an annular body portion (45) terminating in first and second fastening means (54, 56); the first fastening means (54) provided an axially extending rib (65) having opposed first and second surfaces (66, 68) and engagable with one of the sidewalls of the first channel; and the second fastening means (56) provided an axially extending rib (70) having opposed first and second surfaces (74, 75) and engagable with one of the sidewalls of the second channel and a radially extending lip (80) engagable with the door; whereby the stationary drum is sealed to the front panel of the washing machine. A method for sealing a stationary drum (25) to the front panel (13) of a front loading washing machine is also provided.

11 Claims, 5 Drawing Sheets

BELLOWS FOR FRONT LOADING WASHING MACHINES

TECHNICAL FIELD

The present invention relates generally to clothes washing machines. More particularly, the present invention relates to a bellows used to seal the stationary drum of the washer to the washing machine panel. Specifically, the present invention relates to a bellows having barbed attachment ribs used to secure the bellows to the stationary drum and the panel.

BACKGROUND OF THE INVENTION

In a front loading washing machine, clothes are tumbled in and out of a shallow pool of water. To accomplish this tumbling, a stationary drum houses a rotating drum that rotates about a horizontal axis. These drums are mounted within an enclosure. An access hole is formed within a front panel of this enclosure. This hole allows the user to load clothing into and unload clothing from the rotating drum. During operation, a lower portion of both the stationary drum and the rotating drum are filled with water. The rotation of the rotating drum draws the clothes through the water. To prevent water within the rotating drum from escaping between the drum and the enclosure, a sealing gasket or bellows extends from the stationary drum to the front panel. In some instances, this bellows is provided with convolutions and/or drainage holes to direct any water that escapes to an appropriate location.

Known devices attach the bellows in a variety of ways. Clamping mechanisms such as a clamping ring that tightens around the edge of the gasket sandwiching it against the frame and stationary drum members may be used. These devices may be used in combination with adhesives to further secure the bellows. It is also known to use hooks, tabs, or buttons. In a hook arrangement, the edge of the bellows is rolled over or folded over a hook holding the gasket in place. The motion of the washing machine may work the bellows loose from these hooks without additional adhesive or clamping component. In some instances, the machine motion may tear the bellows near the hooks. In the case of tabs, or buttons, a portion of the gasket extends through retaining holes or slots formed within the panel or stationary drum to hold the bellows in place. The intermittent spacing of the retaining holes allows the bellows to pucker or deform after installation, which may result in leakage. As in the case of hooks, the washing machine motion may work these loose tabs and buttons from their retaining holes. To prevent this loosening, additional means are necessary to hold the tabs or buttons within the holes or an adhesive can be used.

From time to time it is necessary to remove the bellows to service the washing machine. Removing bellows attached by known means may damage or destroy the bellows well before its normal life expectancy.

Therefore, there is a need for a bellows that attaches in such a manner that it can be removed and replaced with a reduced chance of destroying the bellows. There is a further need for an improved bellows that is less likely to tear or deform during operation. There is still further need for a washing machine having a bellows that does not require additional means, such as clamps or adhesives to resist disengagement caused by the washing machine motion.

SUMMARY OF THE INVENTION

It is, therefore, an object of the present invention to provide an improved bellows for front loading washing machines that can be removed and replaced with a reduced chance of damaging the bellows attachment mechanism.

It is another object of the present invention to provide an improved bellows having a reusable attachment mechanism.

It is a further object of the present invention to provide a bellows that employs a barbed attachment mechanism.

It is still another object of the present invention to provide a bellows having an attachment rib with flexible protrusions extending therefrom that create an interference fit with grooves formed within the front panel and stationary drum of the washing machine.

It is yet another object of the present invention to provide a bellows having a barbed attachment that resists forces created by the operation of a washing machine.

It is another object of the present invention to provide an improved bellows having a fastening means with flexible protrusions that fold over when the bellows are secured and must be unfolded to remove the bellows.

These and other objects of the invention, as well as the advantages thereof over existing and prior art forms, which will be apparent in view of the following detailed specification, are accomplished by means hereinafter described and claimed.

In general, a bellows for a front loading washing machine embodying the concepts of the present invention is employed with a front loading washing machine having a front panel providing a first channel having opposed sidewalls, an opening and a door carried thereby, and further carrying a stationary drum, and providing a second channel, having opposed sidewalls, The bellows comprising an annular body portion terminating in first and second fastening means; the first fastening means provided an axially extending rib having opposed first and second surfaces and engagable with one of the sidewalls of the first channel; and the second fastening means provided an axially extending rib having opposed first and second surfaces and engagable with one of the sidewalls of the second channel and a radially extending lip engagable with the door; whereby the stationary drum is sealed to the front panel of the washing machine.

The present invention also provides a bellows for sealing a stationary drum to a front panel of a front loading washer, the bellows comprising an annular body portion having first and second annular beads at opposed ends; each bead carrying an axially directed rib and each rib carrying at least one radially extending fin, each rib and fin adapted to engage channels carried by the stationary drum and the front panel, respectively; whereby the stationary drum is sealed to the front panel of the washing machine.

The present invention also provides a method for sealing a stationary drum to the front panel of a front loading washing machine the front panel providing a first channel having opposed sidewalls the stationary drum, providing a second channel, having opposed sidewalls, the washing machine further providing an opening and a door carried thereby. The method comprises providing a bellows having an annular body portion terminating in first and second fastening means; the first fastening means provided an axially extending rib having opposed first and second surfaces and engagable with one of the sidewalls of the first channel; and the second fastening means provided an axially extending rib having opposed first and second surfaces and engagable with one of the sidewalls of the second channel and a radially extending lip engagable with the door; inserting the first fastening means into the first channel, thereby deforming the fin in the direction of insertion; and inserting the second fastening means into the second channel, thereby deforming the fin in the direction of insertion.

To acquaint persons skilled in the arts most closely related to the present invention, one preferred embodiment of a washing machine that illustrates a best mode now contemplated for putting the bellows of the present invention into practice is described herein by, and with reference to, the annexed drawings that form a part of the specification. The exemplary bellows is described in detail without attempting to show all of the various forms and modification in which the invention might be embodied. As such, the embodiment shown and described herein is illustrative, and as will become apparent to those skilled in these arts can be modified in numerous ways within the spirit and scope of the invention; the invention being measured by the appended claims and not by the details of the specification.

DESCRIPTION OF AN EXEMPLARY EMBODIMENT

Figure 1:
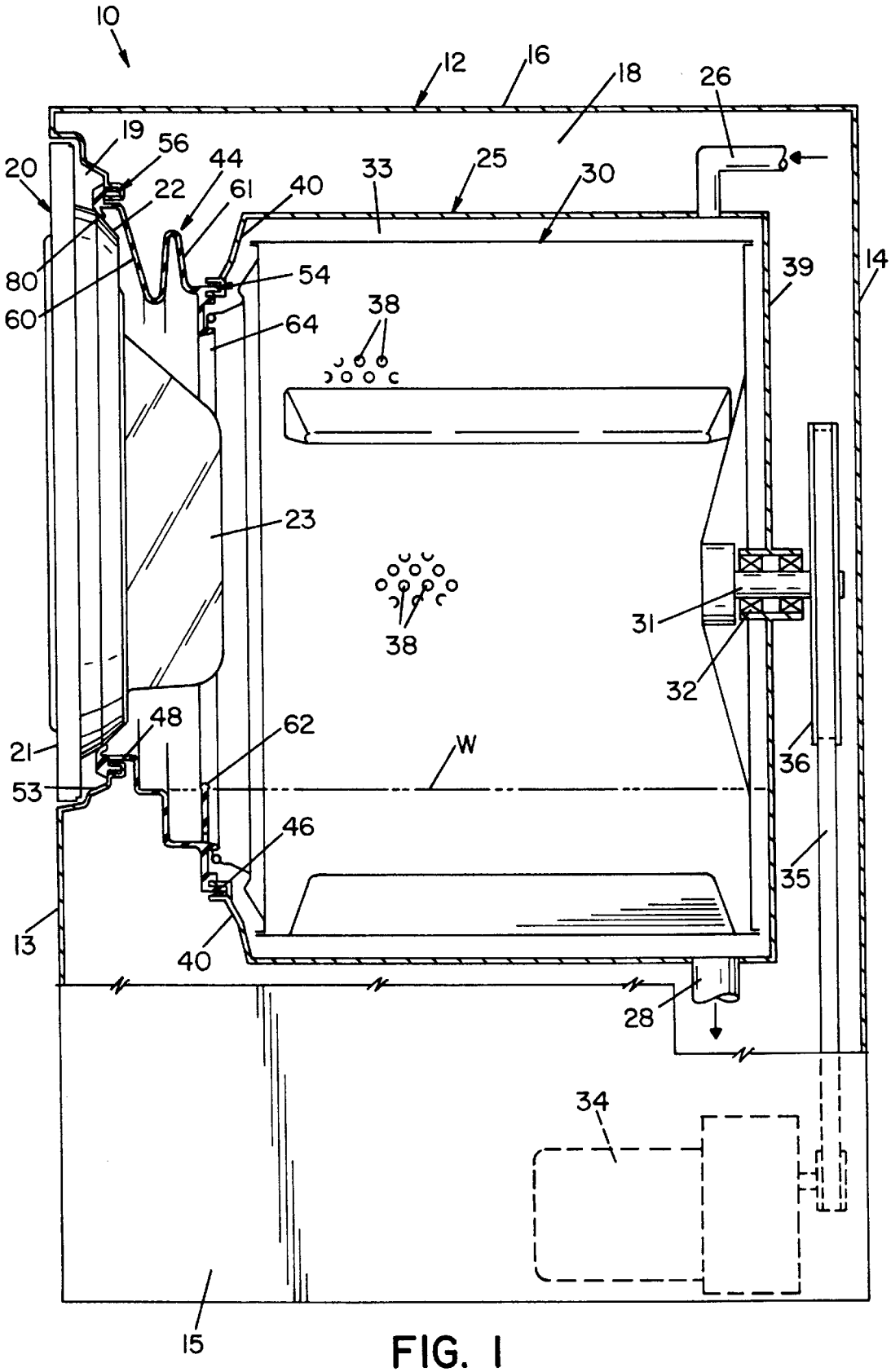
FIG. 1 is a side elevation of a front loading washing machine, partially in section depicting the bellows of the present invention.

One representative form of a washing machine embodying the concepts of the present invention is designated generally by the numeral 10 on the accompanying drawings. The representative washing machine 10 is a front loading washing machine.

In general, a front loading washing machine 10 has a housing generally 12, which may be constructed of a plurality of panels attached to a frame (not shown). The panels may include a front panel 13, a rear panel 14, side panels 15 and a top panel 16. These panels cooperate to define a hollow space 18. Front panel 13 is provided with an opening 19 to provide access to the hollow space. Opening 19 may be located at any height from the supporting surface on which, the washing machine 10 rests. In general, Opening 19 is located near the middle portion of the front panel, slightly above it allow water to be held within the machine.

Opening 19 may be generally circular in shape. A door 20 may be hinged mounted on front panel 13. The door 20 prevents clothing, water, and detergent from being thrown from the washing machine 10. The door 20 typically provides a broad annular front 21, and a inwardly or rearwardly sloping back 22 of lesser diameter and finally, on some models, a transparent window 23 to allow the user to view the washing operation.

A stationary drum 25 is mounted within the hollow space 18, and is provided with at least one inlet 26 for fluid supply and at least one outlet 28 along the lower portion thereof. Both inlet 26 and outlet 28 are provided with means to selectively control the fluid flow into and out of the stationary drum 25, respectively.

A rotating drum 30 is rotatably mounted within and concentrically aligned with stationary drum 25. The rotating drum 30 may be mounted on a shaft 31 located on the outer surface of rotating drum 30. This shaft 31 penetrates stationary drum 25, and is supported by suitable bearings 32. A predetermined amount of clearance 33 is provided between the two drums. The predetermined amount of clearance 33 allows the rotating drum 30 to be driven by a motor 34. The motor 34 may be mounted beneath the stationary drum 25 in a suitable manner. The motor 34 drives rotating drum 30 via a suitable connection, for example a belt 35 and pulley 36.

Rotating drum 30 is provided with a plurality of perforations 38 that fluidly communicate with stationary drum 25. When in operation, stationary drum 25 fills with a shallow pool of water, W. Clothes within rotating drum 30 are tumbled through this shallow pool, and water from the pool passes into the clothes through the perforations 38. The stationary drum 25 is closed at the rear 39 and is open at the front which is formed by short, radially inwardly directed face 40.

Figure 3:
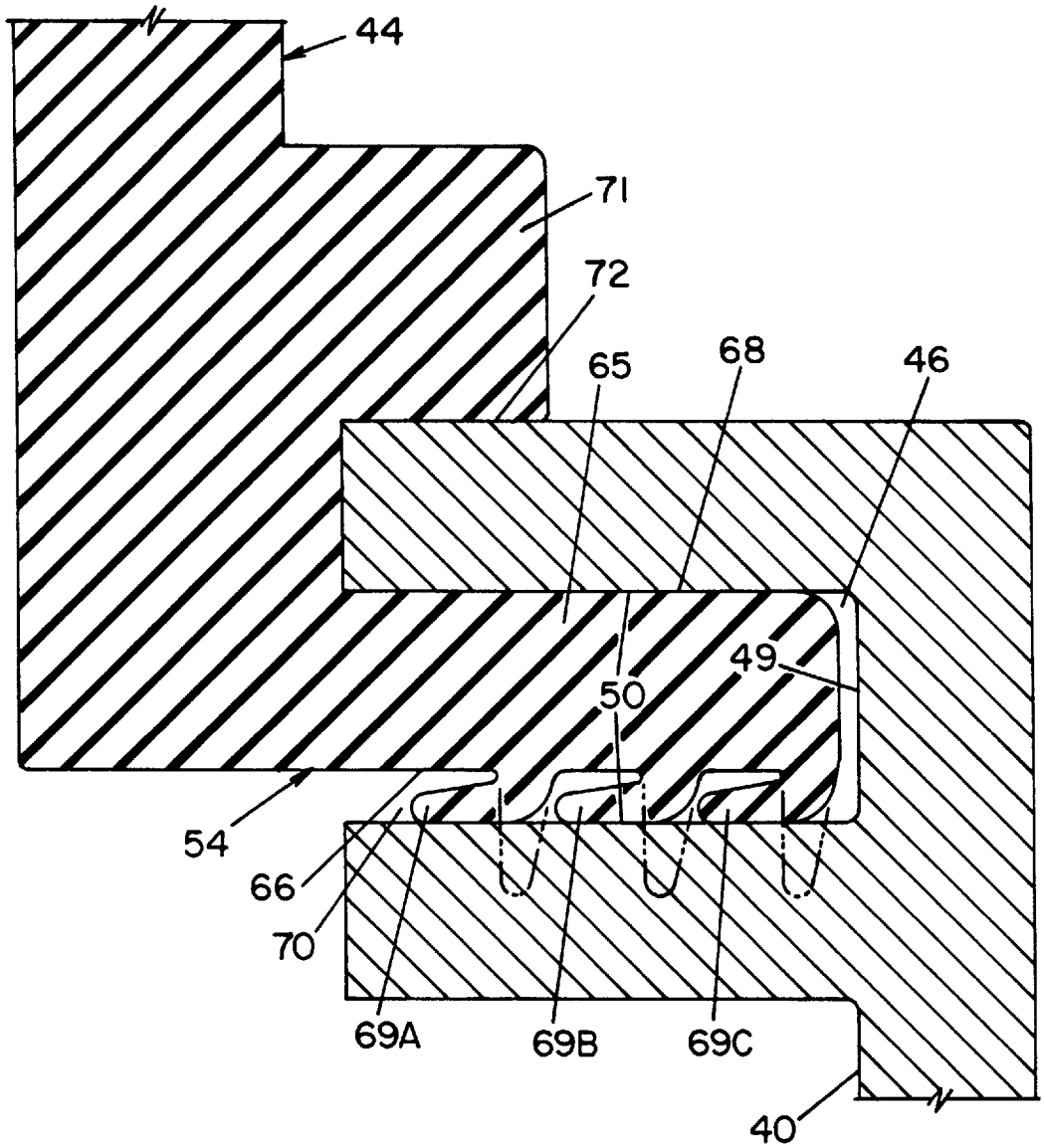
FIG. 3 is an enlarged cross-section of the area encircled and designated in FIG. 2.

To prevent water from entering the hollow space, a bellows generally 44, according to the present invention, is secured between the front face 40 and the front panel 13. Stationary drum 25 and front panel 13 are each provided with annular channels 46 and 48, respectively, for attachment of bellows 44. With reference to FIG. 3 in particular, channel 46 is provided at the inward edge of front face 40 and is defined by a rear wall 49 and upper and lower sidewalls 50. In similar fashion, channel 48 is provided at the edge of the front panel opening 19 and is defined by a rear wall 51 and upper and lower sidewalls 52. Channel 48 is located on the exterior surface 53 of front panel 13. In this arrangement, bellows 44 extends over the front panel aperture edge. Alternatively, channel 48 may be located on the interior surface of front panel 13.

Bellows 44 is generally a flexible annular member 45, having first and second annular beads, or fastening means, generally 54 and 56, respectively. As viewed in FIGS. 1 and 2, the annular beads 54 and 56 are not concentric; bead 56 being concentric with the opening 19 in front panel 13, the center of which is nearer to the top panel 16 of the machine 10 than the center of stationary drum 25. Although the beads have a novel configuration, their non-concentricity is to conform to the construction of the washer 10 which must carry water within the rotating drum 30 while preventing its escape through the washer door 20.

Between the beads, the bellows 44 may be provided with a series of convolutions 57, 58 and 59 in the form of steps at the bottom and folds 60, 61 at the top, to direct any water that has escaped from stationary drum 25 or rotating drum 30 to a suitable drain or otherwise return the water to the drums. As is conventional, a weir 62 is provided from the lowest convolution 59, and within a segment spanning from about 5 o'clock to 7 o'clock, in order to dampen splashing of liquids and also allow water to drain from the drums via apertures 63 in the base of weir 62. A small annular rib 64, extends rearwardly from the outer corner of convolution 59. In the upper area of the bellows, as mounted, this rib 64 functions to deflect water and clothes from movement between stationary and rotatable drums 25 and 30.

Figure 2:
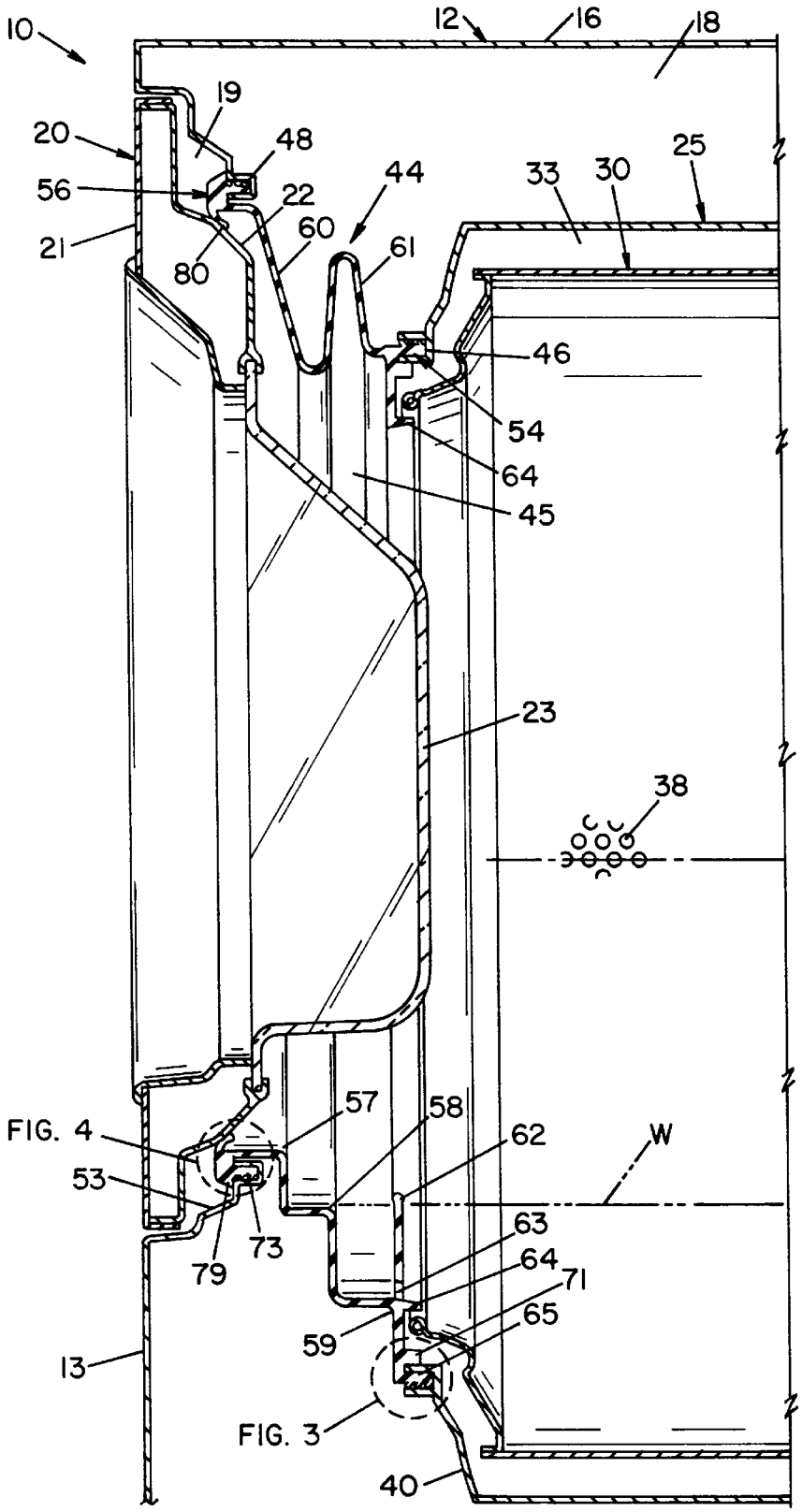
FIG. 2 is an enlarged side elevation of the front loading washing machine depicted in FIG. 1, partially in section, depicting the bellows of the present invention.

With reference to FIGS. 2 and 3, fastening means 54 is releasebly secured to the stationary drum 25 in channel 46. The configuration of fastening means 54 includes an inwardly directed annular rib 65 (toward the rear of the machine 10) having first and second opposed surfaces 66, 68, and at least one radial fin, there being three 69A–69C depicted in FIG. 3, extending from the first surface. While fins 69 have been depicted, it should be recognized that other configurations, such as whiskers, spaced fins or any other shape of flexible member may be used.

The fins 69 preferably have a length greater than the height of gap 70, created when the rib 65 is inserted into the channel 46. Upon insertion, the fins 69 come into contact with the sidewalls of channel 46 causing the fin tips to fold away from the direction of insertion. Once inserted within the channel 46, the fins lie essentially flat with a major portion of their external surfaces making contact with sidewall 50. When the space between fins is less than their folded length, the tips may be tapered to allow the fins to lay generally contiguously upon one another.

To release the fastening means 54, the user pulls the rib 65 opposite from the direction of insertion. When the fins 69 are in a folded configuration, release requires their unfolding, thereby providing resistance to withdrawal, despite a relatively easy insertion. Yet, given the flexibility of fins 69, the rib can be removed from the channel for routine maintenance, cleaning and/or replacement. In the former instances, the bellows is not damaged and hence, can be reinserted after the necessary maintenance or cleaning has been completed.

As part of the fastening means 54, an inwardly directed step 71 is provided above the rib 65 at the foot of last convolution 59 as viewed in FIG. 3 for the lower region of the bellows, which together with rib 65 engages a surface 72 of the channel 46 to provide additional gripping and sealing of the bellows.

Figure 4:
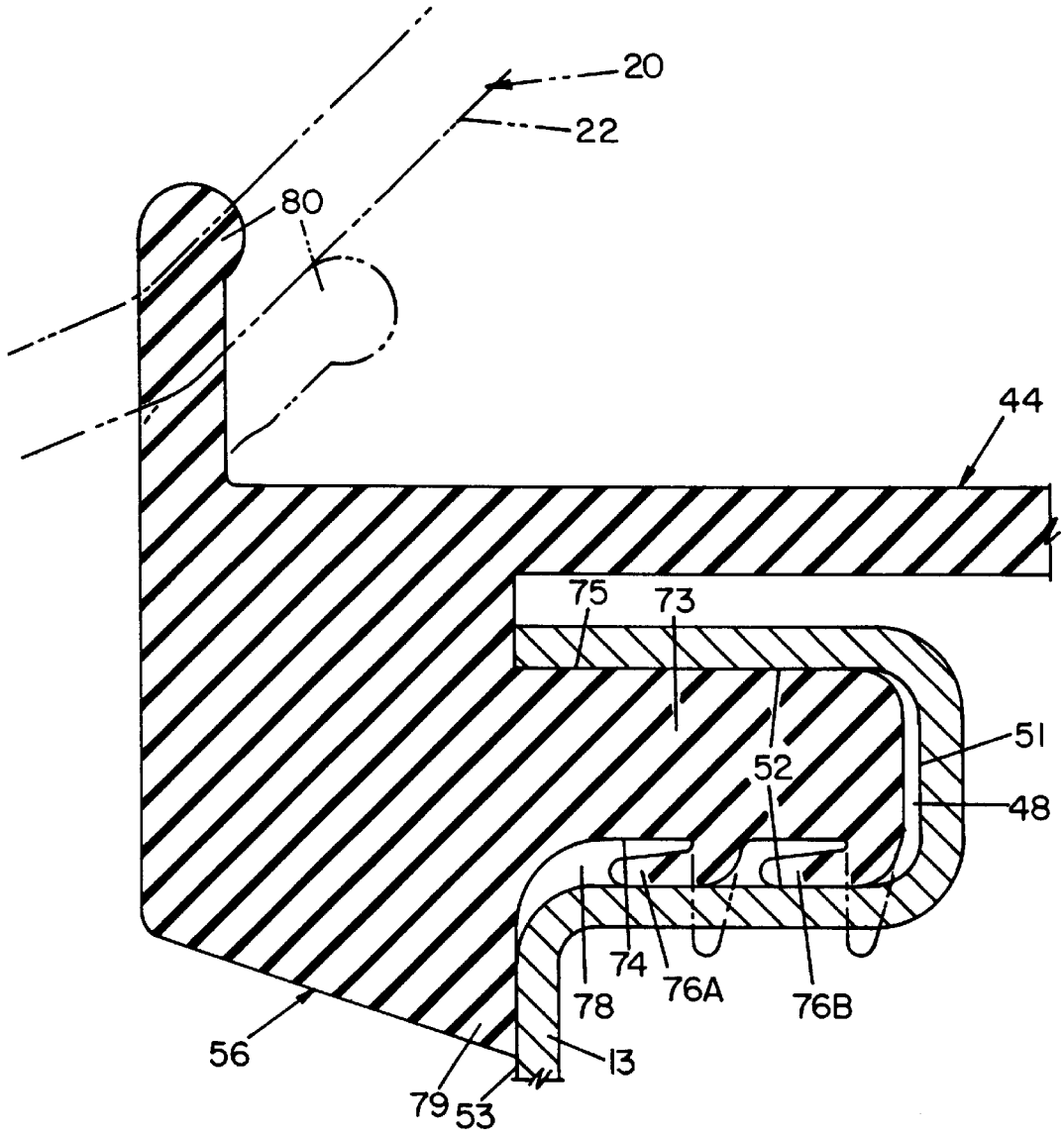
FIG. 4 is an enlarged cross-section of the area encircled and designated in FIG. 2.

With reference to FIGS. 2 and 4, the second fastening means 56 is releasebly secured to the annular channel 48, provided in the front panel 13. The configuration of fastening means 56 also includes an inwardly directed annular rib 73 (toward the rear of the machine 10) having opposed first and second surfaces 74, 75 and at least one radial fin, there being two 76A–76B depicted in FIG. 4, extending from the first surface 74. While fins 76 have been depicted, it should again be recognized that other configurations and shapes of flexible member may be used.

The fins 76 also preferably have a length greater than the height of the gap 78, created when the rib 73 is inserted into the channel 48. Upon insertion, the fins 76 come into contact with the sidewall 52 of channel 48 causing the fin tips to fold away from the direction of insertion. Once inserted within the channel 48, the fins lie essentially flat with a major portion of their external surfaces making contact with sidewall 52. When the space between fins is less than their folded length, the tips may be tapered to allow the fins to lay generally contiguously upon one another.

To release the fastening means 56, the user pulls the rib 73 opposite from the direction of insertion. When the fins 76 are in a folded configuration, release requires their unfolding, thereby providing resistance to withdrawal with relatively easy insertion. Again, given the flexibility of fins 76, the rib can be removed from the channel for routine maintenance, cleaning and/or replacement.

As part of the fastening means 56, a foot 79 is provided which engages a portion of the opening formed in front panel 13. At the opposite end of the fastening means, a radially extending door lip 80 is provided which sealingly engages the door 20, as depicted in phantom in FIG. 4.

Figure 5:
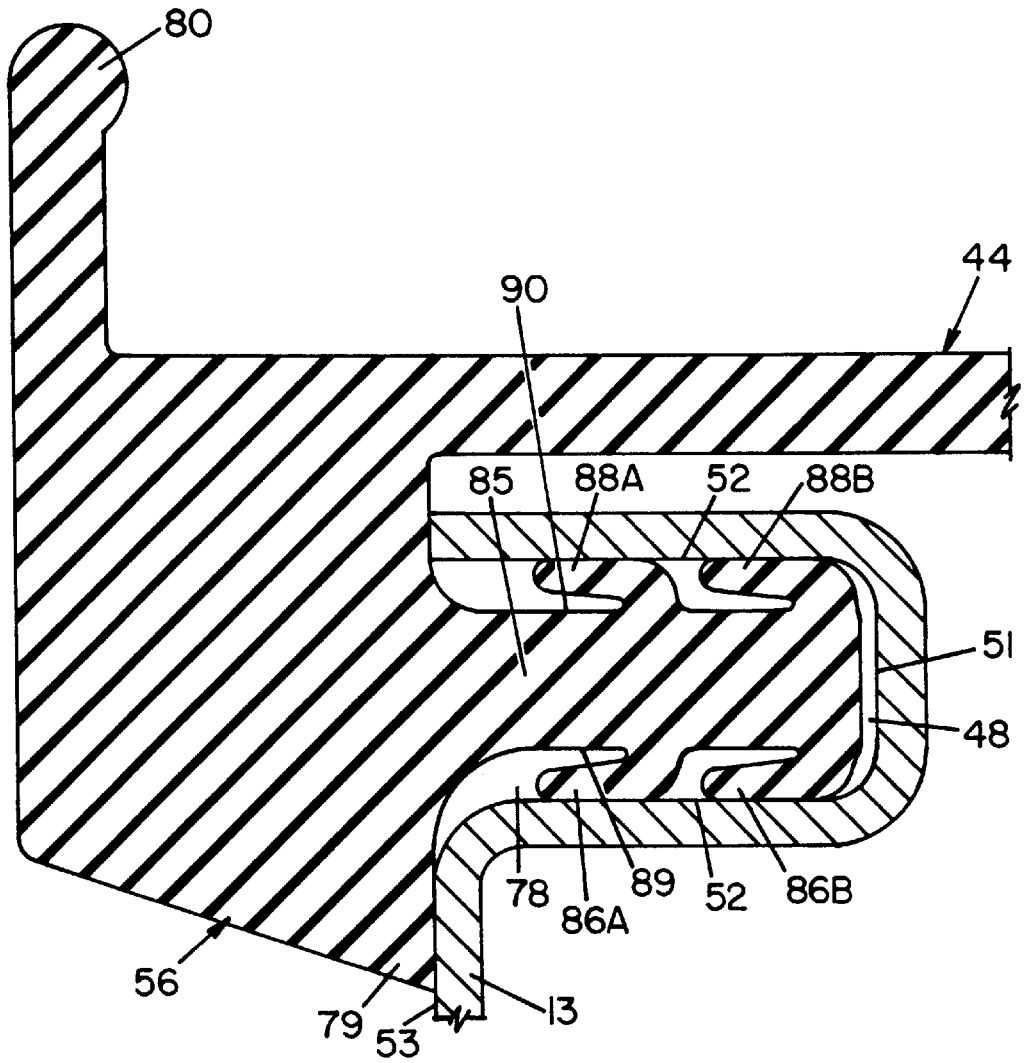
FIG. 5 is an enlarged cross-section, similar to FIG. 4, depicting an alternative structure of the bellows.

Although the ribs 65 and 73 have both been depicted in the drawings thus far described as providing fins on only one surface, it is to be appreciated that fins could be provided on opposed sides. With reference to FIG. 5, a rib 85 is depicted, similar to fin 73 of FIG. 4. It is somewhat narrower and carries a plurality of fins 86A–86B and 88A–88B on opposed surfaces 89, 90, to fit within the channel 48. While the rib 85 is depicted for use within channel 48, it is to be appreciated that in similar fashion, the rib 65 could also be provided with opposed fins for use in channel 46.

As should now be apparent, the bellows 44 is readily installed by inserting the ribs 65 and 73 into channels carried by the stationary drum and front panel, respectively, whereby the fins yield in the direction of insertion. While they also resist withdrawal, owing to their flexibility, it is possible to pull on the fastening means of the bellows sufficiently to cause the fins to rollover within their respective channels whereupon the ribs can be as readily removed as they had been inserted.

Accordingly, the bellows of the present invention can be removed and replaced with a reduced chance of being destroyed. Moreover, the bellows are less likely to tear or deform during operation. Finally, the present invention provides a bellows that does not require additional means, such as clamps or adhesives to resist disengagement caused by the washing machine motion.

While the channels 46 and 48 are not currently present in front loading washing machines, their incorporation into the machine is readily facilitated. Based upon the description provided herein, it should be within the skill of the art to provide structure in the drum and front panel to accommodate the fastening means of the bellows disclosed herein.

In conclusion and as should now be apparent, the present invention not only teaches that a bellows embodying the concepts of the present invention is capable of ready insertion and repeated removal from the washer, but also that the other objects of the invention can be likewise accomplished.

While only a preferred embodiment of the present invention is disclosed, it is to be understood that the same is susceptible to numerous changes apparent to one skilled in the art. Therefore, the scope of the present invention is not to be limited to the details shown and described but is intended to include all changes and modifications which come within the scope of the appended claims. And, while the present invention has been described with reference to the drawings, it is also to be understood that certain variations in the washing machine are possible without interfering with the use of the bellows and thus, practice of the present invention is not to be limited by the washing machine employed.

What is claimed is:

1. A bellows for a front loading washing machine having a front panel providing a first channel having opposed sidewalls, an opening and a door carried thereby, and further carrying a stationary drum, providing a second channel, having opposed sidewalls and a rotatable drum, said bellows comprising:

an annular body portion terminating in first and second fastening means;

said first fastening means provided an axially extending rib having opposed first and second surfaces and engagable with one of said sidewalls of said first channel; and said second fastening means provided an axially extending rib having opposed first and second surfaces and engagable with one of said sidewalls of said second channel and a radially extending lip engagable with said door; whereby said stationary drum is sealed to the front panel of said washing machine.

2. A bellows as set forth in claim 1, wherein said axially extending rib of said first fastening means is thinner than said first channel, having at least one radial fin extending from one of said surfaces deformably engagable with the other of said sidewalls of said first channel.

3. A bellows as set forth in claim 2, wherein said fastening means further carries an annular step spaced radially inwardly from said rib, engagable with a portion of said first channel.

4. A bellows as set forth in claim 1, wherein said axially extending rib of said first fastening means is thinner than said first channel, having at least one radial fin extending from each of said opposed surfaces deformably engagable with the opposed sidewalls of said first channel.

5. A bellows as set forth in claim 1, wherein said axially extending rib of said second fastening means is thinner than said second channel, having at least one radial fin extending from one of said surfaces deformably engagable with the other of said sidewalls of said second channel.

6. A bellows as set forth in claim 5, wherein said fastening means further carries a foot spaced radially outwardly from said rib, engagable with a portion of said front panel.

7. A bellows as set forth in claim 1, wherein said axially extending rib of said second fastening means is thinner than said second channel, having at least one radial fin extending from each of said opposed surfaces deformably engagable with the opposed sidewalls of said second channel.

8. A bellows for sealing a stationary drum to a front panel of a front loading washer, said bellows comprising:

an annular body portion having first and second annular beads at opposed ends;

each said bead carrying an axially directed rib and each said rib carrying at least one radially extending fin, each said rib and fin adapted to engage channels carried by said stationary drum and said front panel, respectively; whereby said stationary drum is sealed to the front panel of said washing machine.

9. A bellows as set forth in claim 8, wherein said axially extending rib of said first annular bead is thinner than said channel provided by said stationary drum, said channel being engaged both by said rib and said fin.

10. A bellows as set forth in claim 8, wherein said axially extending rib of said first annular bead is thinner than said channel provided by said front panel, said channel being engaged both by said rib and said fin.

11. A method for sealing a stationary drum to the front panel of a front loading washing machine the front panel providing a first channel having opposed sidewalls the stationary drum, providing a second channel, having opposed sidewalls, the washing machine further providing an opening and a door carried thereby, said method comprising:

providing a bellows having an annular body portion terminating in first and second fastening means; said first fastening means provided an axially extending rib having opposed first and second surfaces and engagable with one of said sidewalls of said first channel; and said second fastening means provided an axially extending rib having opposed first and second surfaces and engagable with one of said sidewalls of said second channel and a radially extending lip engagable with said door;

inserting said first fastening means into said first channel, thereby deforming said fin in the direction of insertion; and inserting said second fastening means into said second channel, thereby deforming said fin in the direction of insertion.

* * * * *

UNITED STATES PATENT AND TRADEMARK OFFICE

CERTIFICATE OF CORRECTION

PATENT NO. : 6,256,823 B1 
DATED : July 10, 2001
INVENTOR(S) : John J. Sudar and Clarence W. Kronbetter It is certified that error appears in the above-identified patent and that said Letters Patent is hereby corrected as shown below:

Column 8,
Line 19, before the word "engagable", please insert -- a radially extending fin --, and
Line 24, before the word "engageable", please insert -- a radially extending fin --.

Signed and Sealed this

Seventeenth Day of June, 2003

JAMES E. ROGAN
*Director of the United States Patent and Trademark Office*